United States Patent [19]

Peterson

[11] 4,045,157

[45] Aug. 30, 1977

[54] SILENCER DEVICE FOR INDUSTRIAL BURNERS

[75] Inventor: Robert J. Peterson, Hillsdale, N.J.

[73] Assignee: American Can Company, Greenwich, Conn.

[21] Appl. No.: 681,773

[22] Filed: Apr. 30, 1976

[51] Int. Cl.[2] ..... F23D 15/02

[52] U.S. Cl. ..... 431/114; 181/35 A; 181/50; 181/36 D; 181/42

[58] Field of Search ..... 431/114; 181/35 A, 36 D, 181/42, 50, 55

[56] References Cited

U.S. PATENT DOCUMENTS

| | | | |
|---|---|---|---|
| 2,433,618 | 12/1947 | McCollum | 431/114 X |
| 2,452,780 | 11/1948 | McCollum | 431/114 X |
| 3,720,497 | 3/1973 | Arenson | 431/114 |
| 3,840,326 | 10/1974 | Schreter | 431/114 |
| 3,940,234 | 2/1976 | Reed et al. | 431/114 X |

*Primary Examiner*—Edward G. Favors

*Attorney, Agent, or Firm*—Robert P. Auber; Eliot S. Gerber; Ira S. Dorman

[57] ABSTRACT

A silencer device for an industrial burner is adapted to be positioned over the air intake orifice of the burner tube of the industrial burner and provides two separate air intake paths. One of the air paths is through a central outer port and then between a cylindrical noise suppressing core member, having a perforated conical face on one end backed by a noise absorbent material, and the inner perforated wall of a toroid-shaped member. The other air path is through circumferential openings at the rear end of the silencer device.

8 Claims, 3 Drawing Figures

SILENCER DEVICE FOR INDUSTRIAL BURNERS

BACKGROUND OF THE INVENTION

The present invention relates to noise reduction devices and more particularly to a muffler for the combustion air intake of a burner tube of an industrial burner.

At the present time there are various types of burners used for industrial applications. For example, one type of industrial burner utilizes propane as its fuel. Such burners may include an elongated combustion chamber (burner tube) having a combustion air intake at one of its ends and an exhaust means, such as an exhaust stack, connected to its opposite end. The gaseous fuel is injected and burns within the elongated chamber.

One use of that type of burner is as a "propane vaporizer." A propane vaporizer may be used to add heat to liquid propane to convert the liquid propane into a gas which is then burned to heat drying ovens or for other purposes. One type of propane vaporizer comprises an elongated U-shaped burner tube, which is its combustion chamber and which is surrounded by water within an enclosing tank. One or more coils are connected to the liquid propane storage tanks and connected through the outer wall of the enclosing tank and through the water. Propane is burned along with air in the combustion chamber and heats the water to convert the liquid propane into gaseous form. For example, the burner type combustion chamber may be 13 inches in diameter and 20 feet in length.

In the prior art, an intake air orifice of the burner tube is covered by a wind screen at one end of the combustion chamber and its opposite end is connected to an exhaust stack. The wind screen (wind shield) is a metal plate having louvres to prevent gusts of wind from directly entering the combustion chamber and is vertical relative to the ground. Generally the combustion occurs with a low-frequency rumbling noise which is hardly noticeable except to workers in its immediate vicinity. However, under certain wind conditions a low-frequency high-amplitude noise may be produced. The noise and vibration may be so loud ad objectionable that persons 100 feet away find it difficult to work or to concentrate.

The inventor has solved that noise problem by his invention of the silencer device of the present invention, which tends to keep the air pressure at the burner air inlet orifice relatively steady. The silencer device of the present invention accomplishes such relatively steady pressure by utilizing a front air port leading around a core member and a rear circumferential air port. When wind blows at an angle toward the front end of the silencer device, it will raise the air pressure at its front end air intake port and lower the pressure at its rear air intake port. Since air is taken through both air intake ports, the pressure within the silencer device at the air intake orifice of the burner tube will stay relatively steady.

Upon an analysis of the problem, it was found by the present inventor that the loud noise was produced in the prior art burner only when the wind blew in certain directions relative to its air intake orifice. The loud noise was not produced when the wind was directed more or less directly into, or directly away from, the wind screen. On the other hand, when the wind was more or less across the wind screen, for example, about 30° to 80° relative to an imaginary axis running through the burner tube and through the wind screen, the loud noise may occur. It was hypothesized that the loud noise was due to a standing noise wave which was started within the burner tube by the wind. The standing wave, as it reinforced itself over and over again by reflections from the two opposite ends of the burner tube, became so loud as to pose a noise pollution problem. The reflecting surface at one end of the burner tube was the wind screen and the reflecting surface at the other end was the curved portion of the U-shaped burner tube.

There have been, in the patent literature, various proposals for absorbing or reducing sound. For example, in U.S. Pat. No. 3,692,140 to C. D. Smith, a sound absorber is shown which includes a perforated metal sheet which is backed by a sound absorbent material. The sound suppressor of the Smith patent was used as the muffler on a gas turbine. The device illustrated in FIG. 5 of the Smith patent includes an interior sound absorber which is described and being circular and concentric. In U.S. Pat. No. 2,964,121 to J. S. Zink, Jr., a muffler for a gaseous fuel aspirator is shown which includes a skirt portion having a perforated metal liner backed by a sound absorbing material. As illustrated in its FIG. 2, the air direction 56 is around the flared end portion 24 of the inspirating device.

In U.S. Pat. No. 3,819,319, and similarly in U.S. Pat. No. 3,840,326, both to Schreter, a noise attenuator for a turbocompressor is placed in air flow communication with the combustion chamber air inlet. The Schreter U.S. Pat. No. 3,819,319 states that the low-frquency noise is the most difficult to attenuate and that a Helmholtz chamber has been incorporated into the combustion chamber to absorb and to selectively attenuate the noise of the low-frequency range (col. 12, lines 66–68). In addition, another acoustic attenuator is placed in "air flow communication chamber air inlet" (col. 2, lines 13–14). The second acoustic attenuator has partitions defining a plurality of passageways. Each of the partitions is hollow and made from spaced metal sheets and "joined at the rear by riveting, welding or the like to form a tapered trailing edge" (col. 14, lines 13–15). A sound absorbing material fills each of the enclosed partitions. In U.S. Pat. Nos. 2,580,655 (Chipley), 2,801,518 (Wosika) and 3,748,085 (Peopsel), silencers are used in connection with an air inlet and include a perforated wall which is backed by a sound absorbing material.

SUMMARY OF THE INVENTION

In accordance with the present invention, a silencer device is provided for use with an industrial burner. The silencer device may be added or "retrofitted" to existing industrial burners, for example, to existing propane vaporizers, without extensively rebuilding the burners, by positioning the silencer device of the present invention over the air inlet orifice of the burner tube.

The silencer device of the present invention provides two air paths, one at its fore end and one at its rear end. These mair paths are so arranged that wind which raises the air pressure at one of the entries into the air paths will lower the air pressure at the entry into the opposite air path. Wind which blows across the silencer creates a high pressure zone at one of its ends and a balancing low pressure zone at its other end.

The silencer device of the present invention is described as being a cylindrical device which is adapted to fit over a burner tube having a circular air intake orifice. However, it will be understood that other shapes may be utilized, depending upon the shape of the air intake orifice. In general, the silencer device of the present invention comprises an outer toroid member having a continuous metal outer wall and a perforated metal inner wall. The space between its inner and outer walls is filled with a noise absorbent material, preferably fiberglass. A noise absorbing core member is held in the center of the toroid by means of support bars.

The support bars provide a free air path between the open central outer end of the silencer and between the inner noise absorbing core member and the inner wall of the toroid. The noise absorbing core member has a cone-shaped perforated metal wall which is of the same size as the air intake orifice of the burner tube and which faces that tube and is separated from it. A second circumferential air path is formed between the rear end of the toroid member and the air intake orifice by leaving a space between the outer wall of the pipe forming the orifice and the inner wall of the toroid.

OBJECTIVES AND FEATURES OF THE INVENTION

It is an objective of the present invention to provide a silencer device for a burner which will reduce the escape of objectionable noise from the burner.

It is a further objective of the present invention to provide such a silencer device which will protect the combustion air intake of the burner tube from gusts and changing direction of wind and will enable the air pressure at its air intake orifice to remain reasonably constant, regardless of the direction of the wind.

It is a further objective of the present invention to provide such a silencer device which will prevent build-up of standing noise waves within the elongated burner tube and thereby prevent such standing air waves from causing objectionable noise.

It is a feature of the present invention to provide a silencer device adapted to be positioned near the combustion air intake orifice of the burner tube of an industrial burner. The silencer device comprises an outer toroid member having an outer wall and an inner wall separated from the outer wall. The inner wall is perforated and the space between the inner and outer toroid walls contains sound absorbed material. The front end of the toroid member forms a front air intake port.

A core member is positioned within the toroid member and has, preferably, a conical face of perforated heat-resistant material facing the orifice. The core member contains sound absorbent material behind its conical face. The silencer device also comprises means to fasten the core member to the inner wall of the toroid member to thereby form a first air passage which leads from the front port of the toroid member between the core member and the inner wall of said toroid member, to the intake orifice of the burner tube. Means to secure the silencer device to the burner tube forms a second air passage between the intake orifice and the rear end of said toroid member.

The burner tube is fastened to the silencer device with the burner tube intake orifice within the toroid member. The burner receives combustion air from both of the air passages and noise from the burner tube is suppressed.

BRIEF DESCRIPTION OF THE DRAWINGS

Other objectives and features of the present invention will be apparent from the following detailed description of the invention which provides the inventor's best mode of practicing the invention. The following detailed description of the invention should be taken in conjunction with the accompanying drawings.

In the drawings.

Figure 1:
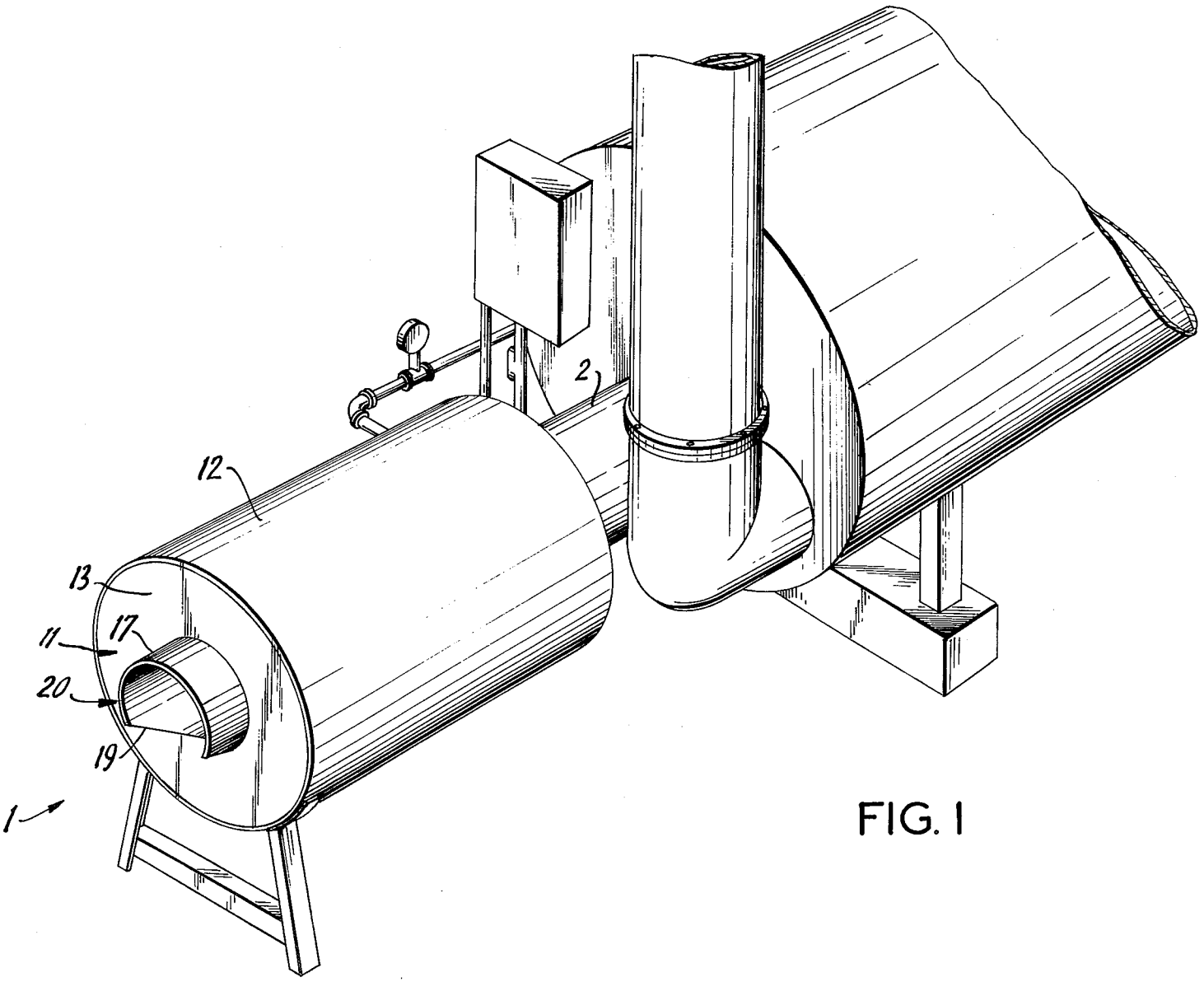
FIG. 1 is a perspective view of the silencer device of the present invention shown attached at the air inlet end of the burner tube of a propane vaporizer.
Figure 3:
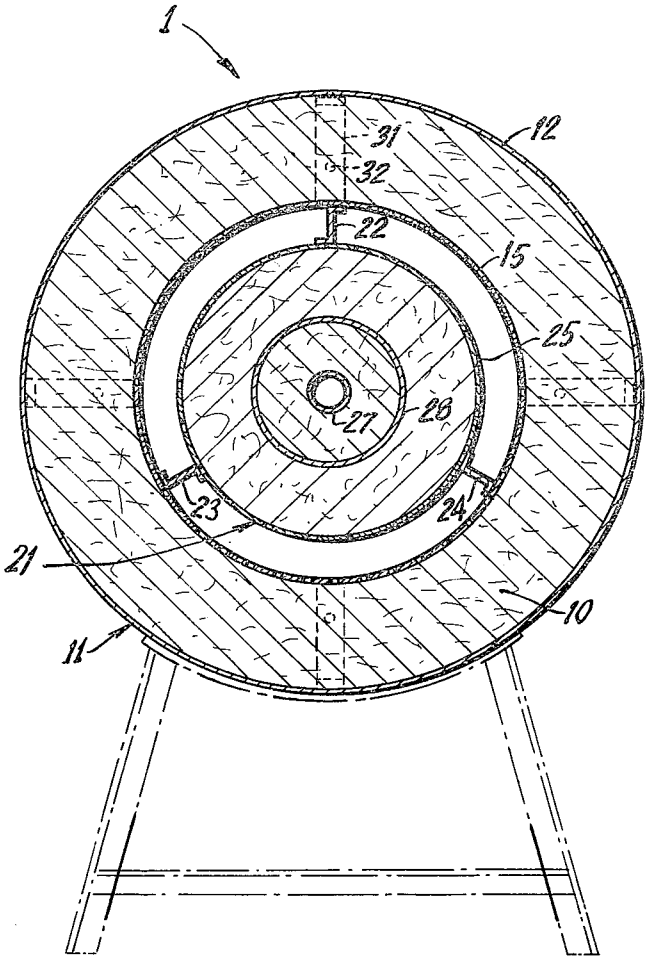
FIG. 3 is a transverse cross-sectional view of the silencer of the present invention taken along line 3—3 of FIG. 2.
Figure 2:
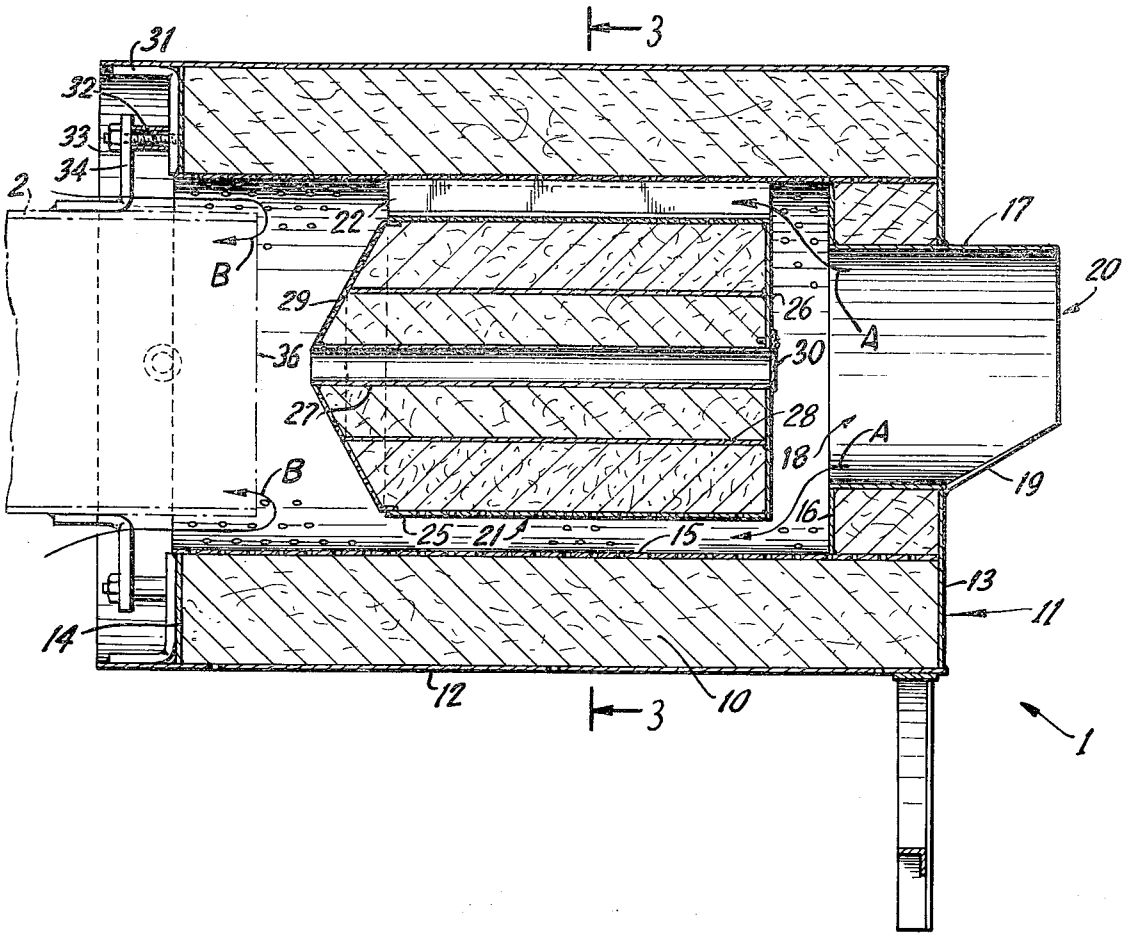
FIG. 2 is a longitudinal cross-sectional view of the silencer device of the present invention.

As shown in the accompanying drawings, and more particularly at FIGS. 2 and 3, the silencer 1 of the present invention includes a toroid outer member 11 in the form of a cylindrical casing. The size of the silencer device will depend upon the size of the burner tube orifice and the length of its combustion chamber. The dimensions set forth in this detailed description of the invention are illustrative of an embodiment of the present invention which may be utilized with a propane vaporizer having a round air intake orifice 13 inches in diameter and having a U-shaped burner tube combustion chamber with each leg of the U being about 20 feet in length. In this embodiment a suitable silencer may have an outer diameter of about 32 inches and the length of the outer wall of the toroid member will be about 44 inches.

The toroid outer member 11 has an outer cylindrical wall 12 which is constructed of sheet metal and does not have perforations. At its end portions, the toroid member has an outer end wall 13 in the form of a flat ring of sheet metal and an inner end wall 14 also in the form of a flat ring of sheet metal. An inner cylindrical wall 15 of the toroid member is also made of sheet metal and is spaced from the outer wall 12 a sufficient distance to contain sound absorbent material 10.

In the specific embodiment described herein, a suitable spacing between the outer cylindrical wall 12 and the inner cylindrical wall 15 is about 6 inches. A suitable sound absorbent material is flexible glass fibers (fiberglass) which may be, for example, Owens-Corning Type 703 Fiberglass (T.M. of Owens-Corning) packed at a density of 3 pounds per cubic foot. An inner shoulder wall 16 in the form of a flat ring of sheet metal is fastened near its outer circumference to the inner cylindrical wall 15 so that it is perpendicularly aligned thereto. An air intake neck member 17, of sheet metal, is fastened to the inner shoulder 16 and to the outer end wall 13. The neck member 17 is preferably cylindrical at its inner portion 18 and has a flared bottom portion 19. The neck member 17 forms the first air intake orifice 20.

An inner sound absorbing core member 21 is centrally positioned within the toroid outer member 11. The inner sound absorbing core member 21 is held in position by three evenly spaced support bars 22, 23 and 24, as shown particularly in FIG. 3. Each support bar 22, 23 and 24 is fastened at one of its ends to the inner cylindrical wall 15 and fastened at its opposite end to the sound absorbing core member 21.

The sound absorbing core member 21 is cylindrical and comprises a cylindrical outer wall 25 in the form of sheet metal perforated with a large number of openings, as is the opposing inner cylindrical wall 15. For example, the openings may be a series of ⅛ inch holes on 3/16 inch staggered centers which provides about 40% of its surface area with openings. Alternatively, one may utilize 9/64 inch diameter holes on 7/32 inch centers, which will provide about 38% of the total surface area with openings. The sound absorbent core member 21 also includes a flat sheet metal outer end member 26 which is ring-shaped and unperforated. The outer edge of the ring-shaped end member 26 is mounted on one end of the cylindrical wall 25. The other end of the outer wall 25 supports a conical member 29 which is also a sheet metal perforated member.

An elongated inner tube 27, without perforations, is positioned within the core member 21 and is used to view the flame within the burner tube. The outer end of the tube 27 is normally closed by a movable cover plate 30 which may be swung to one side. A cylindrical sheet metal tubular wall 28, without perforations, is used for strength and support. The space between the walls 25 and 28 and the space between the wall 28 and inner tube 27 are both filled with a sound absorbing material, preferably fiberglass.

In order to mount the silencer 1 on a burner tube 2, a number of support brackets 31 are secured at the rear end of the toroid outer member 11 by being welded to the inner end wall 14 and the outer cylindrical wall 12. The support brackets 31 are secured to brackets 34 fastened to the burner tube 2 by means of bolts 33 and spacer bushings 32.

A second air path, which is circumferential air path, is formed between the rear end of the toroid outer member 11 and the orifice 36 of the burner tube 2, as shown by the arrows marked B passing between the burner tube 2 and the inner cylindrical wall 15. The first air path is shown by arrows marked A passing from the intake orifice 20 between the core 21 and cylindrical wall 15.

In operation, the inventor believes the standing noise waves are reduced by the present invention in the following manner. Outside air blowing in the direction into the first air passage from intake orifice 20, as shown by the arrows A, raises the air pressure at the front end of the silencer device and lowers the air pressure at its rear end, so that the total pressure at the burner tube orifice 36 will be reasonably constant. Similarly, if air blows from the opposite direction toward the rear of the silencer device into the second air passage, shown by the arrows B, the air pressure at the rear will raise and air pressure at its front will be lowered, again resulting in a reasonably steady pressure at the burner tube orifice 36. This steady pressure at the burner tube orifice 36 reduces the likelihood of the setting up of standing noise waves.

In addition, the conical end member 29 of the sound absorbing core member 21 and the perforated inner cylindrical wall 15, both with noise absorbing backing material, will tend to absorb or suppress any standing wave noises from the burner tube. Indeed, it is believed that the presence of the conical end member tends to prevent the establishment of such standing waves.

What is claimed is:

1. A silencer device adapted to be positioned near the combustion air intake orifice of the burner tube of an industrial burner; comprising an outer toroid member having an outer wall and an inner wall separated therefrom, said inner wall being perforated, the space between said inner and outer toroid walls containing sound absorbed material therein, the front end of said toroid member forming a front air intake port;

a core member within said toroid member, said core member having a face of perforated heat-resistant material directed toward said burner tube air intake orifice, said core member containing sound absorbent material behind said face;

means to fasten said core member to the inner wall of said toroid member to thereby form a first air passage from the front air intake port of said toroid member, between said core member and said inner wall of said toroid member, to said intake orifice of the burner tube;

means to secure said silencer device to said burner tube and to thereby form a second air passage between said burner tube intake orifice and the rear end of said toroid member;

whereby the burner tube may be fastened to the silencer device with its intake orifice within said toroid member and said burner tube receives combustion air from both of said air passages and whereby noise from said burner tube is suppressed.

2. A silencer device as in claim 1 wherein said core face is conical.

3. A silencer device as in claim 1 wherein said sound absorber material within the core member and within the toroid member is fiberglass.

4. A silencer device as in claim 1 wherein said inner and outer toroid walls are sheet metal.

5. A silencer device as in claim 1 wherein the toroid member has a front sheet metal flat ring and a rear sheet metal flat ring each connected to the said outer wall and the said inner wall.

6. A silencer as in claim 1 wherein said core member includes a central viewing tube covered at one of its ends by a removable cover.

7. A silencer device as in claim 1 wherein said core is cylindrical and has an outer perforated metal wall backed by said sound absorbent material.

8. A silencer device adapted to be positioned near the combustion air intake orifice of the burner tube of an industrial burner; comprising an outer cylindrical toroid member which is round in cross-section having an unperforated sheet metal outer wall and a sheet metal inner wall separated therefrom, a front sheet metal flat ring and a rear sheet metal flat ring each having its outer circumference connected to said outer wall and its inner circumference connected to said inner wall, said inner wall being perforated, the space between said inner and outer toroid walls containing sound absorbed material therein, the front end of said toroid member forming a front air intake port;

a cylindrical core member within said toroid member, said core member having a conical face of perforated heat-resistant material directed toward and facing said orifice, and a perforated sheet metal cylindrical outer wall, said core member containing sound absorbent material behind said conical face and behind said outer wall;

support bars to fasten said core member as the center of said toroid member, said bars being secured to the inner wall of said toroid member to thereby form a first air passage from the front port of said toroid member and between said core member and said inner wall of said toroid member to said intake orifice;

means to secure said silencer device to said burner tube and to thereby form a second air passage between said burner tube and the rear of said toroid member;

whereby the burner tube may be fastened to the silencer device with its intake orifice within said toroid member and said burner tube receives combustion air from both of said air passages and whereby noise from said burner tube is suppressed.

* * * * *